US007300172B1

(12) United States Patent
Lefler

(10) Patent No.: US 7,300,172 B1
(45) Date of Patent: Nov. 27, 2007

(54) ILLUMINABLE ATTACHMENT FOR VACUUM WAND

(76) Inventor: Jo Ann Lefler, 6802 Rogue River Dr., Shady Cove, OR (US) 97539

( * ) Notice: Subject to any disclaimer, the term of this patent is extended or adjusted under 35 U.S.C. 154(b) by 58 days.

(21) Appl. No.: 11/220,310

(22) Filed: Sep. 6, 2005

(51) Int. Cl.
*F21L 4/00* (2006.01)

(52) U.S. Cl. ..... 362/191; 362/396; 362/249; 362/253

(58) Field of Classification Search ..... 362/190–191, 362/396, 389, 253
See application file for complete search history.

(56) References Cited

U.S. PATENT DOCUMENTS 2,047,045 A * 7/1936 Veenboer ..... 362/249
2,637,062 A 5/1953 Sutton et al.
3,112,889 A 12/1963 Marmo et al.
3,752,407 A * 8/1973 Baugh et al. ..... 362/123
4,358,708 A * 11/1982 Silva et al. ..... 315/58
4,542,447 A 9/1985 Quakenbush
4,788,631 A 11/1988 Fuller
4,876,816 A 10/1989 Triplett
5,167,446 A 12/1992 Haroutunian
5,422,801 A * 6/1995 Sangalli, Jr. ..... 362/252
5,560,703 A 10/1996 Capps, III
5,842,301 A 12/1998 Cassem
5,983,443 A 11/1999 Redding
6,276,088 B1 8/2001 Matthews et al.

FOREIGN PATENT DOCUMENTS

GB 167.989 8/1921
WO WO03/027566 4/2003

* cited by examiner

*Primary Examiner*—Ali Alavi
(74) *Attorney, Agent, or Firm*—Michael I Kroll

(57) ABSTRACT

An illuminable attachment for a tube having a clamp movable from an open position to a closed position engaging the walls of said tube. The illuminable element is comprised of a housing having a lamp, power supply, switch and circuit means within said housing mountable by said clamp to a tube.

31 Claims, 9 Drawing Sheets

ILLUMINABLE ATTACHMENT FOR VACUUM WAND

BACKGROUND OF THE INVENTION

1. Field of the Invention

The present invention relates generally to illumination and, more specifically, to an illuminable attachment for a vacuum hose or wand.

The illuminable attachment for a tube, such as a vacuum wand is comprised of a pair of arms matingly hinged forming a clamp movable from an open position to a wand engaging closed position with releasably engaging locking members. The arms form a housing having a plurality of LEDs, power supply, switch and circuit means therebetween whereby said attachment can be user selectively mounted and illuminated as desired.

The illumination provides the user means to better see while using the vacuum in no light or poorly lit areas such as under furniture, in closets, corners, and other areas that are subject to shadowed or poor lighting.

The lamp is comprised of a series of LEDs that provide good illumination with low power consumption. The power is a DC source generated from a battery or battery pack. In one embodiment, the battery(s) are rechargeable.

A switch affixed to the housing is supplied to enable or disable the LEDs while not in use. The clamp housing provides a quick release member and hinge for easy attachment and/or removal from the vacuum tube.

To accommodate tubes of various diameters, the illuminable attachment of the present invention may include various size rubber gaskets. The inner diameter of the rubber gasket is equal to the diameter of the tube and the outer diameter is equal the clamp diameter. The gaskets may also be fabricated of a firm, compressible material which would provide greater flexibility when dealing with vacuum attachments having non-standard diameters such as English versus metric.

2. Description of the Prior Art

There are other devices designed for displaying variables. Typical of these is U.S. Pat. No. 2,637,062 issued to Sutton et al on May 5, 1953.

Another patent was issued to Marmo et al. on Dec. 3, 1963 as U.S. Pat. No. 3,112,889. Yet another U.S. Pat. No. 4,542,447 was issued to Quakenbush on Sep. 17, 1985 and still yet another was issued on Nov. 29, 1988 to Fuller as U.S. Pat. No. 4,788,631.

Another patent was issued to Triplett on Oct. 31, 1989 as U.S. Pat. No. 4,876,816. Yet another U.S. Pat. No. 5,167,446 was issued to Haroutunian on Dec. 1, 1992 and still yet another was issued on Oct. 1, 1996 to Capps, III as U.S. Pat. No. 5,560,703.

Another patent was issued to Cassem on Dec. 1, 1998 as U.S. Pat. No. 5,842,301. Yet another U.S. Pat. No. 5,983,443 was issued to Redding on Nov. 16, 1999 and still yet another was issued on Aug. 21, 2001 to Matthews et al. as U.S. Pat. No. 6,276,088.

Additionally, a United Kingdom patent was issued to Weiss on Aug. 25, 1921 as Patent No. GB167,989 and an International Patent Application Number WO 03/027566 was published on Apr. 3, 2003 to Gillette U.S. Pat. No. 2,637,062

Inventor: Otis B. Sutton et al.

Issued: May 5, 1953

This invention relates to suction cleaners and more particularly to those of the so-called off the-floor type in which a suction nozzle or other air tool is connected to an air moving means by means of a flexible hose whereby the air tools may be moved about for cleaning bare floors, carpets on the floor, drapes on the wall, furniture, Venetian blinds, heating radiators, or to perform any other such household task.

U.S. Pat. No. 3,112,889

Inventor: Michael L. Marmo et al.

Issued: Dec. 3, 1963

This invention relates to flashlights, and more particularly to flashlights which are adapted to be carried or worn on the wrist and supported about the wrist by a strap. A primary object of the invention is the provision of a wrist flashlight including a strap for attaching the flashlight to the wrist, wherein the outer surface of the strap is provided with spaced parallel flexible metallic strips which are connected in series with the flashlight battery and light bulb so that when the hand is positioned to engage any portions of the two contact strips with a metallic object or surface the circuit is automatically closed to energize the bulb.

U.S. Pat. No. 4,542,447

Inventor: Timothy L. Quakenbush

Issued: Sep. 17, 1985

A flashlight attachment for a firearm, for illuminating a target in darkness, comprises a lightweight flashlight casing which clips underneath the firearm barrel, and a touch switch for operating same which is connected to circuit leads extending from the casing, the touch switch being releasably secured to the firearm handle by Velcro fasteners so that it may be operated by hand pressure by a user of the firearm without the user having to release his or her grip on the handle. The attachment may be speedily and efficiently attached to a firearm and removed therefrom.

U.S. Pat. No. 4,788,631

Inventor: Raymond C. Fuller

Issued: Nov. 29, 1988

A wrist mounted flashlight has a sliding lens. The lens has a white light section and a red light section. The case of the flashlight contains batteries and electrical contacts. An arm is attached to the lens and extends into the case. Sliding the lens to either the red light or the white light position causes the arm to engage the electrical contact with the batteries and bulb to energize the light. The bulb in mounted at an inclination relative to the wrist contacting surface of the case. The bulb extends into a space between the batteries.

U.S. Pat. No. 4,876,816

Inventor: Melvin W. Triplett

Issued: Oct. 31, 1989

A target illuminating aiming system, for use with a firing weapon in reduced lighting, is provided with a light assembly for generating light and a light focusing assembly for directing the light generated by the light assembly at a target area into a first zone and a second zone. The second zone generally overlies the first zone and provides sufficient illumination of the target area such that an individual firing the weapon is better able to identify the target area. The first zone is alignable with the trajectory of a projectile fired form the weapon such that the projectile impacts in or near that portion of the target defined by the first zone.

U.S. Pat. No. 5,167,446

Inventor: Vahe Haroutunian

Issued: Dec. 1, 1992

A handgun grip accessory for attachment to the tubular casing of a flashlight to enable the person to hold the flashlight and at the same time hold and aim a pistol at an objected illuminated by the flashlight in a two-handed grip.

U.S. Pat. No. 5,560,703

Inventor: Lewis W. Capps, III

Issued: Oct. 1, 1996

A mounting device for mounting a flashlight on a handgun has a first bracket for attachment to the grip of the handgun, the bracket being contoured to the surface of the handgun grip and engageable with the grip by friction. The bracket which engages the grip, extends partially around the grip, and is further urged against the grip by means of an elastic band. The first bracket is connected to a second bracket which holds a flashlight in desired alignment for coinciding with the barrel of the gun. The second bracket is located away from the grasping surface except for an upper region that is welded flush to the first bracket so as to not interfere with normal gripping of the gun. This attachment system avoids problems associated with fitting of prior attachments into holsters for handguns and provides a simple, readily attached and removed lighting device.

U.S. Pat. No. 5,842,301

Inventor: Craig Jeffery Cassem

Issued: Dec. 1, 1998

A lightweight flashlight attachment for fishing poles which will illuminate the end of a fishing pole and the fishing pole eyelets in darkness. The flashlight attachment includes a lightweight flashlight which can be quickly and easily attached to and detached from fishing poles and will remain attached to a fishing pole even when the pole is cast by the fisherman.

U.S. Pat. No. 5,983,443

Inventor: Glenn E. Redding

Issued: Nov. 16, 1999

There is provided an accessory attachment with a built-in light for attachment to a vacuum cleaner. The accessory is preferably of modular design and is detachably connected in air flow relationship to a hose of the vacuum cleaner at one part, is adapted for detachable connection to an attachment such as a crevice tool at one part, and is detachably connected to a power source at one part, preferably a portable power source such as a battery pack, or the power supply line of the vacuum cleaner.

U.S. Pat. No. 6,276,088

Inventor: John Wallace Matthews et al.

Issued: Aug. 21, 2001

Apparatus for firing projectiles at targets and for illuminating such targets combine a projectile-firing weapon and a target illuminator. A track-and-slide combination includes a slide on the target illuminator and a track on the weapon for that slide, and a releasable slide-in-track stop in such track-and-slide combination. In the case of a firearm that has a trigger actuated by a bent trigger finger of a shooter for the firing thereof, a push-button or transverse slide switch for the target illuminator may be mounted within reach of a pad of such trigger finger prior to actuation of the trigger. For example, the shooter may draw the firearm with his or her trigger finger then outstretched for actuation of the target illuminator switch, and may then bend such trigger finger for firing of the weapon by actuation of the trigger. Such and other appliances may have a battery compartment, and a contact plate interconnecting batteries in such compartment. A contact plate retainer may be coupled to that contact plate, and a contact plate retainer receptacle may be provided therefor in the battery compartment.

U.K Patent Number GB 167,989

Inventor: Cora Mae Weiss

Issued: Aug. 25, 1921

Sighting-accessories. A clip for securing a flash-lamp to a gun barrel comprises a plate, having arms encircling the barrel B, and a split ring 19, encircling the lamp tube C, and having lugs adapted to be screwed to the plate. The plate is curved on one face to fit the barrel, and is flat on the other. The ends of the arms are formed with aperture lugs adapted to be locked together by a pin.

International Patent Application Number WO 03/027566

Inventor: Jay V. Gillette

Published: Apr. 3, 2003

A flashlight and bracket device attachable to a cordless drill for illuminating the drilling region. The bracket clips into the screwdriver bit holder cavity of any cordless drill. The bracket and flashlight case can have a plastic or metal bracket attached by fastening with adhesive, rivets, bolts, wire ties, and welding. The bracket has a rectangular element attached to the flashlight case and a cylindrical element which snaps into a spring clip in a cavity in the housing of the cordless drill.

While these illuminable devices may be suitable for the purposes for which they were designed, they would not be as suitable for the purposes of the present invention, as hereinafter described.

SUMMARY OF THE PRESENT INVENTION

A primary object of the present invention is to provide an illuminable device for attaching to a tube or cylindrical object.

Another object of the present invention is provide an illuminable device having a clamp movable from an open and closed position engaging the walls of a tube or cylindrical object.

Yet another object of the present invention is to provide an illuminable device for attaching to a vacuum hose and/or wand.

Still yet another object of the present invention is to provide improved means to vacuum in poorly lit areas such as under furniture, in closets, or in shadows of a room.

Still yet another object of the present invention is to provide an illuminable device that includes a lamp consisting of a series of LEDs.

Still yet another object of the present invention is to provide an illuminable device that utilizes DC power consisting of a battery or battery pack.

Additional objects of the present invention will appear as the description proceeds.

The present invention overcomes the shortcomings of the prior art by providing an illuminable attachment for a tube having a clamp movable from an open position to a closed position engaging the walls of said tube. The illuminable element is comprised of a housing having a lamp, power supply, switch and circuit means within said housing mountable by said clamp to a tube.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
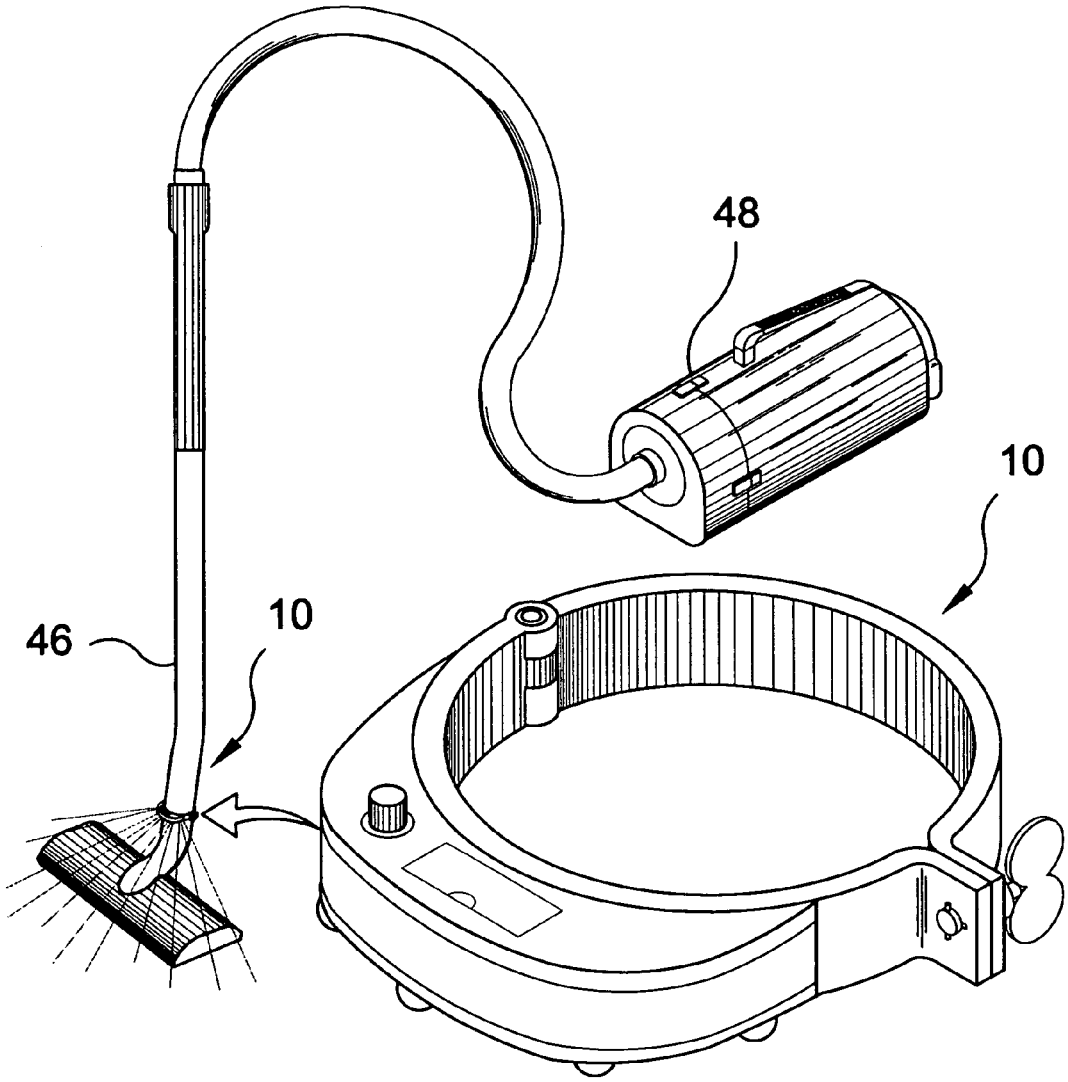
FIG. 1 is an illustrative view of the present invention in use.

Turning now descriptively to the drawings, in which similar reference characters denote similar elements throughout the several views, the figures illustrate the Illuminating Attachment for a Vacuum Wand of the present invention. With regard to the reference numerals used, the following numbering is used throughout the various drawing figures.

10 Illuminating Attachment for a Vacuum Wand of the present invention
12 clamp member
14 first clamp element
16 second clamp element
18 clamp element securing means
19 housing
20 light source
22 light array
24 light port
26 LED
28 DC battery
30 battery compartment
32 flange
34 push spring quick-release
36 thumbplate of 34
38 shaft of 34
40 locking post of 34
41 spring of 34
42 keyway
44 cut-out of 42
46 vacuum wand
48 vacuum cleaner
50 hinge
52 power switch
54 non-slip coating
56 vacuum head
58 reducer bushing "A"
60 reducer bushing "B"
62 reducer bushing "C"
64 interior diameter of reducer bushing "A"
66 interior diameter of reducer bushing "B"
68 interior diameter of reducer bushing "C"

DETAILED DESCRIPTION OF THE PREFERRED EMBODIMENT

The following discussion describes in detail one embodiment of the invention (and several variations of that embodiment).

This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10 in use. The present invention is an illuminable attachment 10 for a tube, such as a vacuum wand 46 for a vacuum cleaner 48 whereby said attachment 10 can be user selectively mounted and illuminated as desired.

Figure 2:
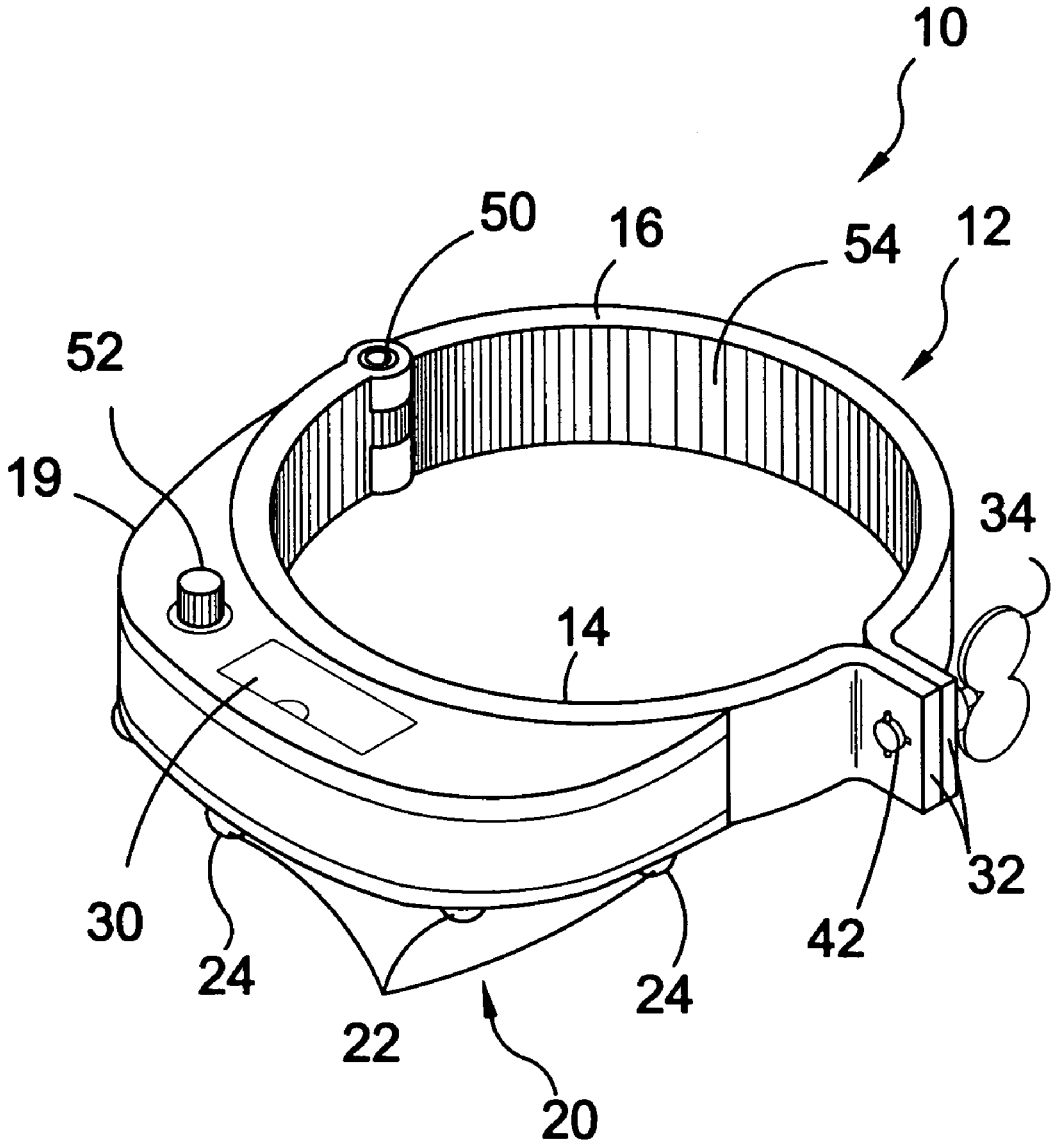
FIG. 2 is a perspective view of the present invention.

FIG. 2 is a perspective view of the present invention. Shown is a perspective view of the illuminable attachment 10 for a vacuum wand 46 comprising a first semicircular clamp element 14 and a second opposing semicircular clamp element 16 matingly connected at one end by a hinge 50 forming a clamp member 12 that is placed over the vacuum wand in the open and then closed therearound. Mating flanges 32 are provided on the distal ends of the clamp elements 14,16 with a push spring quick-release 34 and cooperating keyway 42 to provide a means for securing the illuminable attachment 10 to the vacuum wand. A housing 19 is disposed on the second clamp member 14 to support a light source 20 comprising a light array 22 of spaced apart light ports 24, an on/off power switch 52 and a battery compartment 30. A rubber non-slip coating 54 is applied to the interior portion of the clamp member 12 to prevent it from sliding along the vacuum wand during use.

Figure 3:
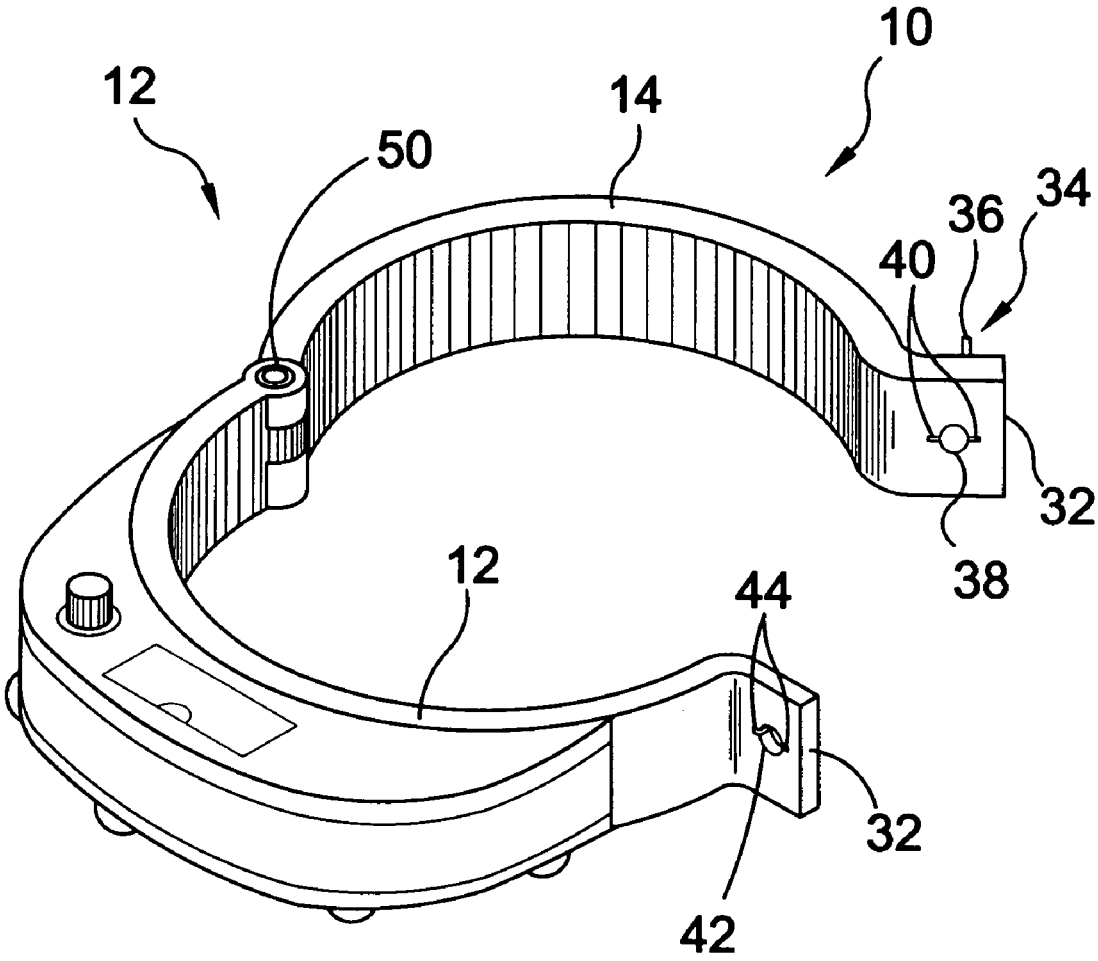
FIG. 3 is a perspective view of the present invention in an open position.

FIG. 3 is a perspective view of the present invention in an open position. Shown is the clamp member 12 open with the flanges 32 of the first clamp element 14 and the second clamp element 16 separated and pivoted apart on the hinge 50. The push spring quick-release 34 has a thumb plate 36 with a shaft 38 and locking posts 40 extending from the distal end thereof for insertion through the keyway 42 and cut-outs 44 when closing and securing the illuminable attachment 10 to the vacuum wand. Turning the thumb plate 36 misaligns the locking posts 40 with the cut-outs 44 to prevent the flanges 32 from separating. Realigning the locking posts 40 with the cut-outs 44 enables the user to separate the flanges 32 and remove the illuminable attachment 10.

Figure 4:
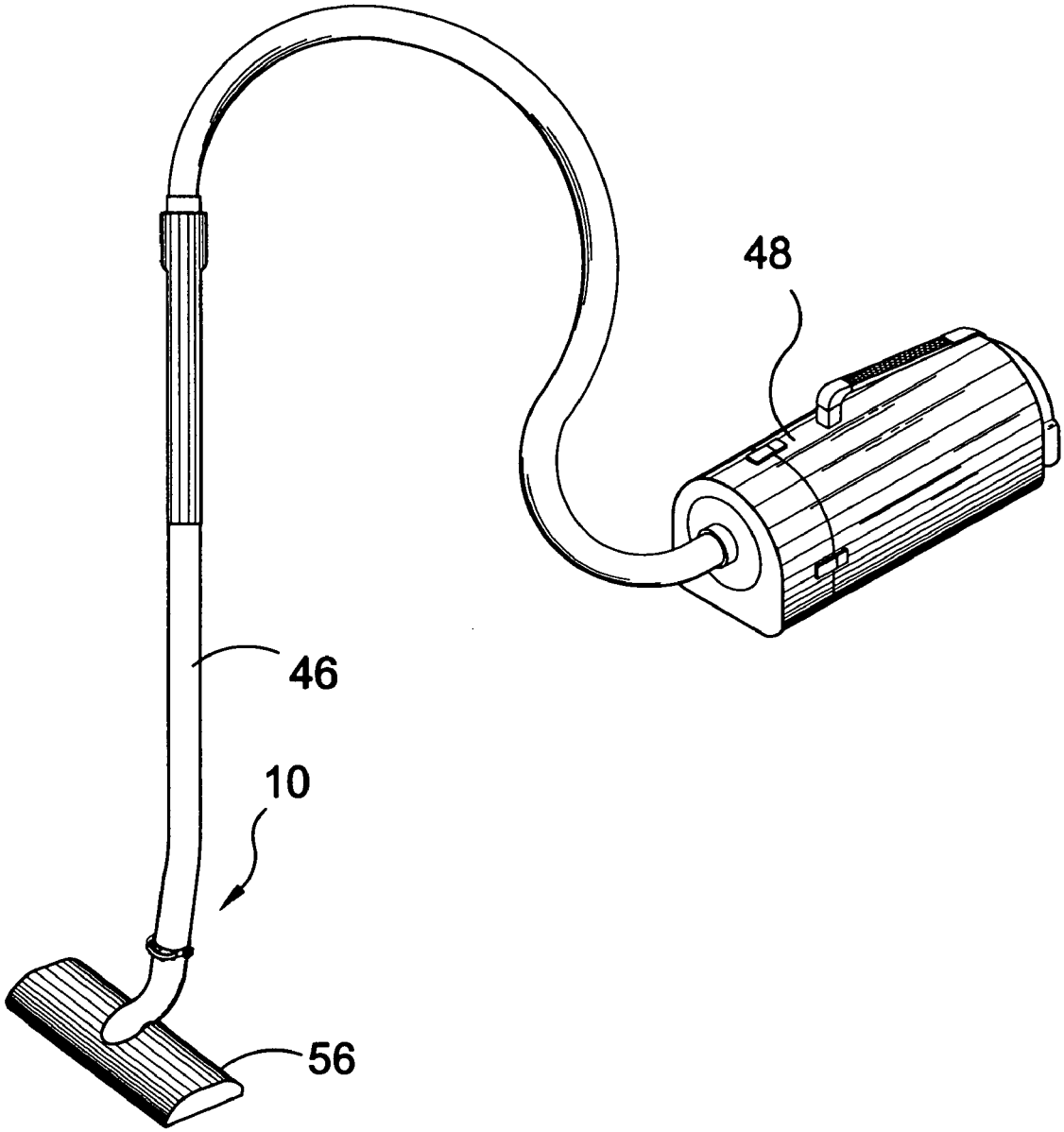
FIG. 4 is a perspective view of the present invention in use.

FIG. 4 is a perspective view of the present invention in use. The present invention is an illuminable attachment 10 for a tube, such as a vacuum wand 46 for a vacuum cleaner 48 whereby said attachment 10 can be user selectively mounted and illuminated as desired, usually with the light oriented toward the front area of the vacuum head 56.

Figure 5:
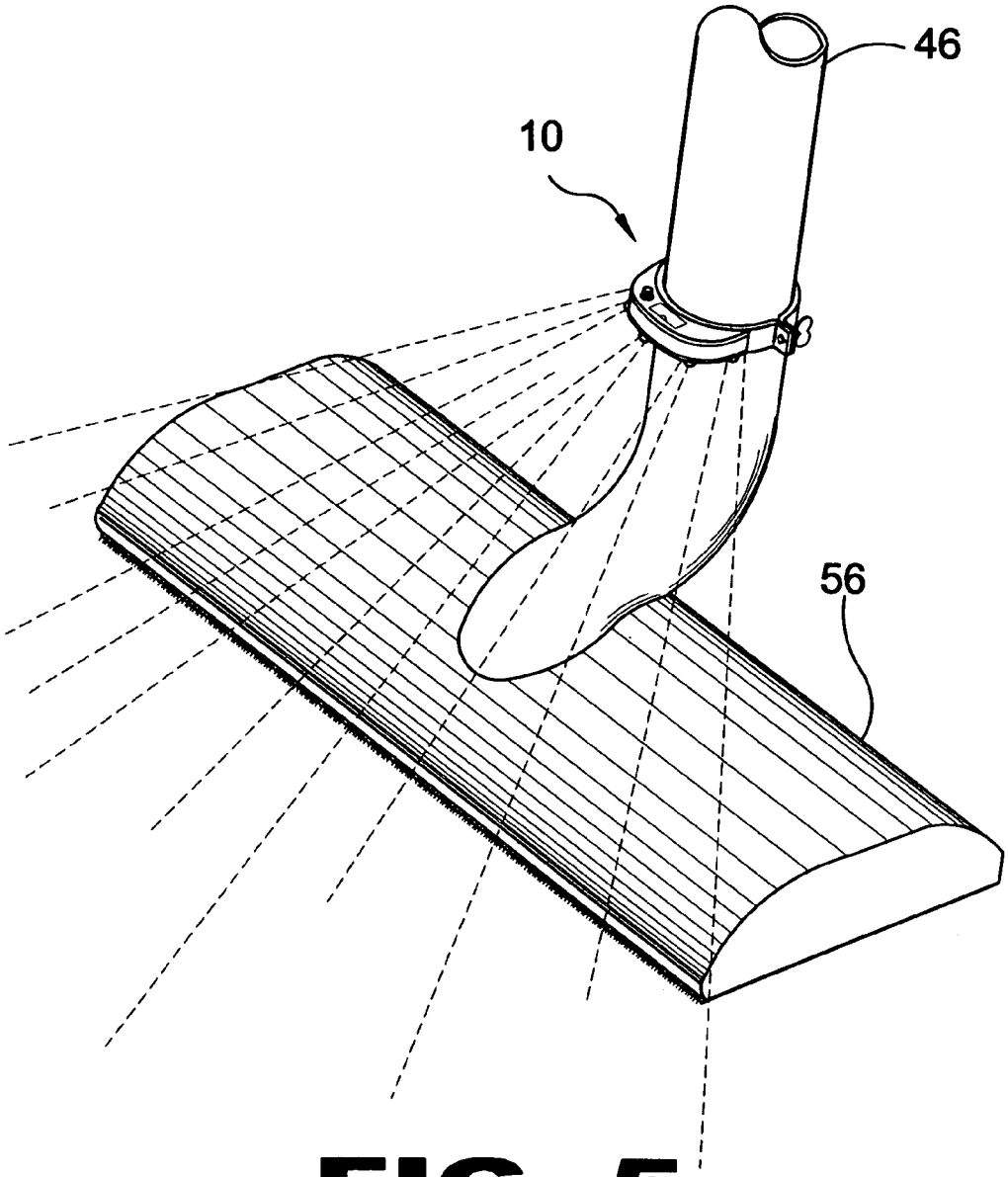
FIG. 5 is an enlarged view of the present invention in use.

FIG. 5 is an enlarged view of the present invention 10 in use. Shown is an enlarged view of the present invention 10 mounted onto a vacuum wand 46 that when energized illuminates the area proximal to the vacuum head 56 being vacuumed.

Figure 6:
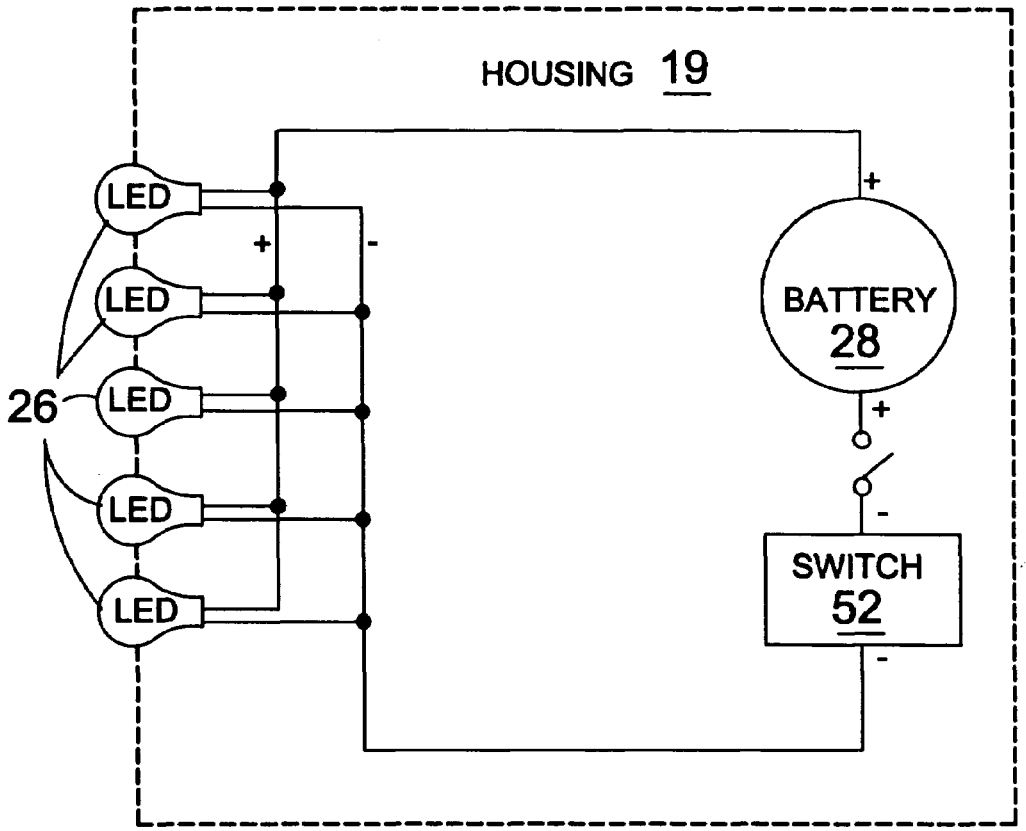
FIG. 6 is a schematic diagram of the present invention.

FIG. 6 is a schematic diagram of the present invention. Shown is a schematic diagram of the present invention. The lamp housing 19 provides a DC battery 28 as a power supply activated by a switch 52 and circuit means to illuminate a series of LEDs 26.

Figure 7:
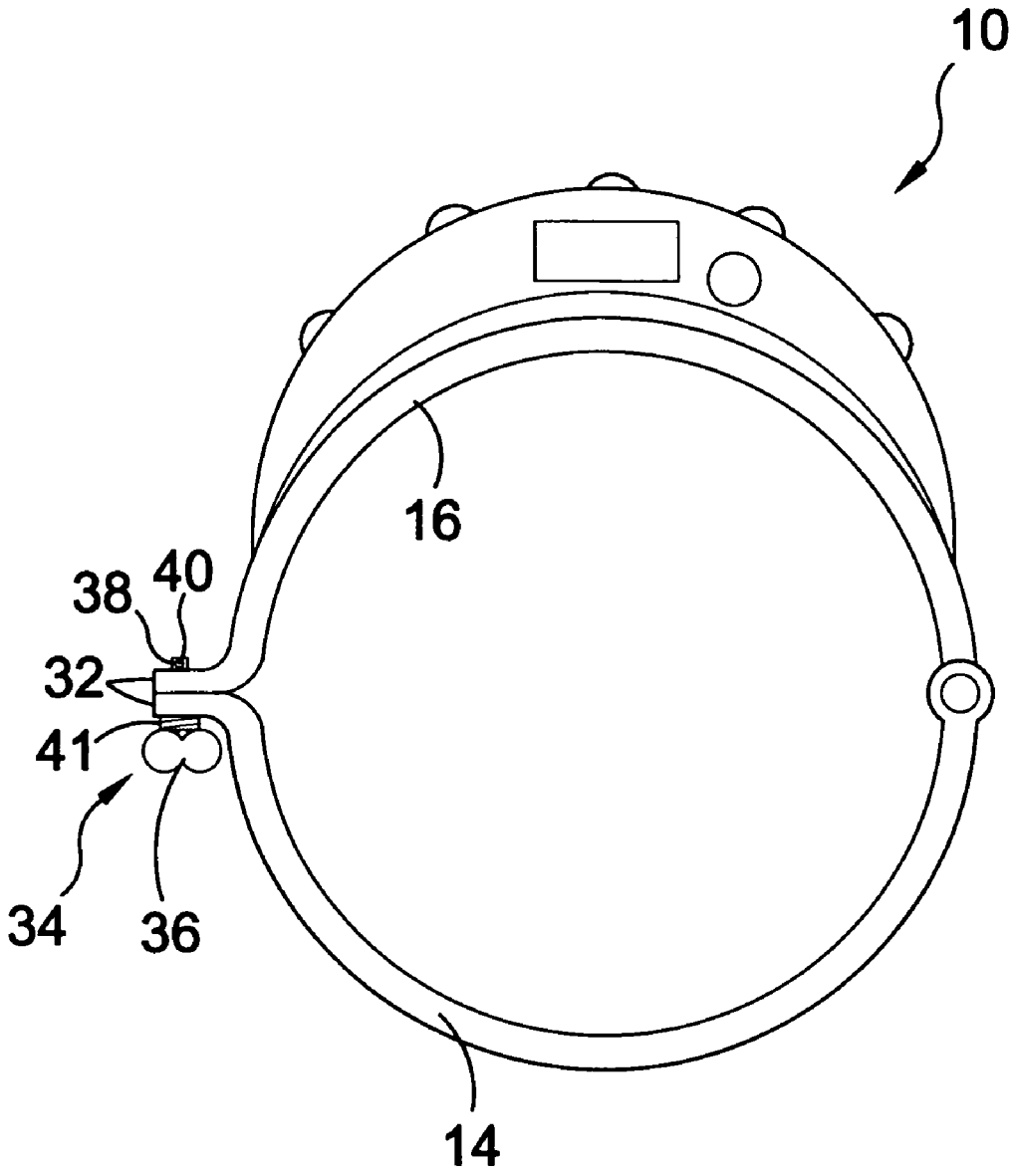
FIG. 7 is a top view of the present invention in a closed position.

FIG. 7 is a top view of the present invention in a closed position. Shown is a top view of the present invention 10 with the flange 32 of the first clamp element 14 flush against the flange 32 of the second clamp element 16 and retained thereagainst by the push spring quick-release 34. The thumb plate 36 was turned thereby misaligning the locking posts 40 on the shaft 38 with the cut-outs in the keyway. The compressed spring 41 provides tension.

Figure 8:
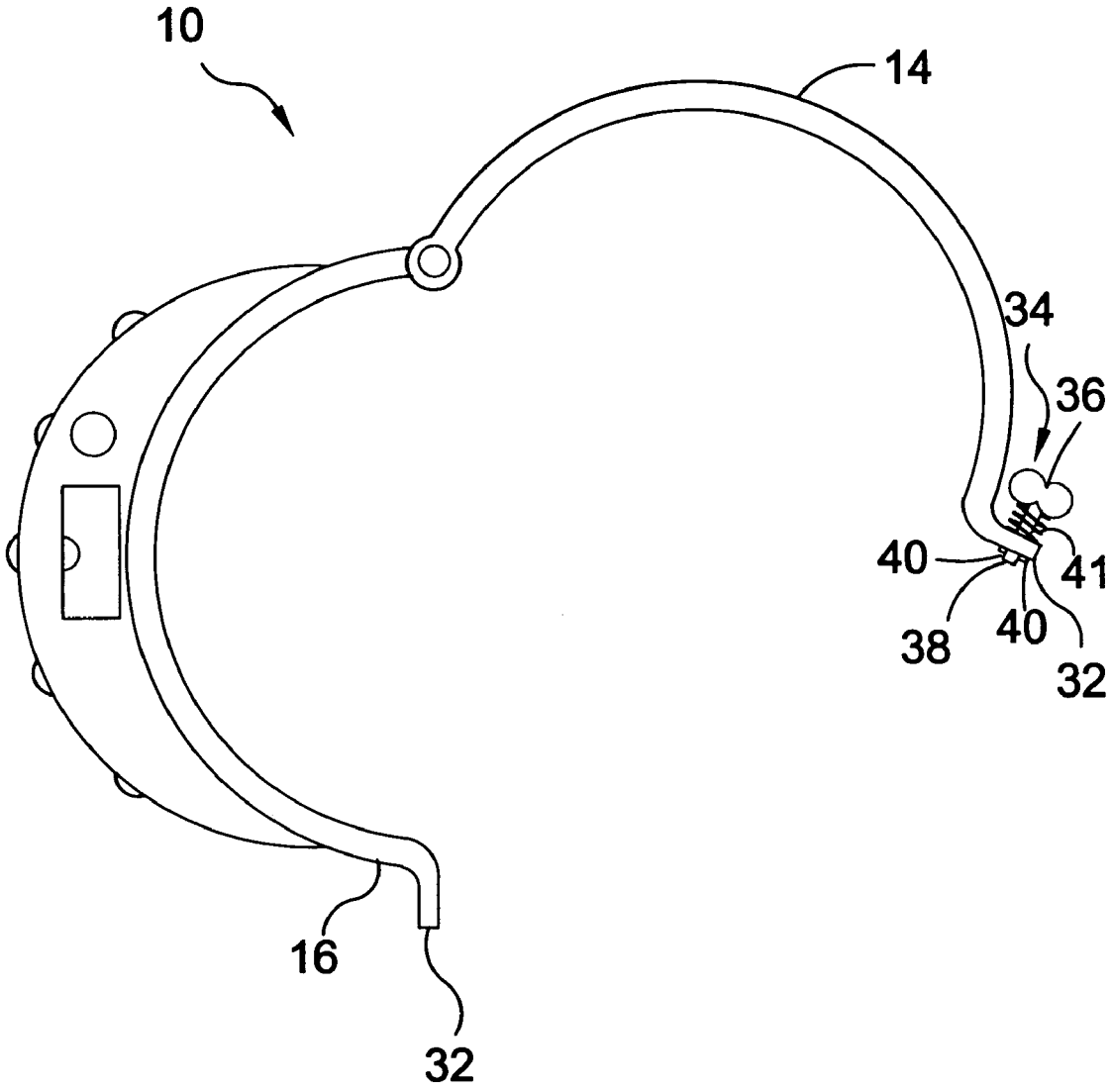
FIG. 8 is a top view of the present invention in an open position.

FIG. 8 is a top view of the present invention 10 in an open position. Shown is a top view of the present invention 10 with the flange 32 of the first clamp element 14 separated from the flange 32 of the second clamp element 16. The thumb plate 36 was turned thereby aligning the locking posts 40 on the shaft 38 with the cut-outs in the keyway and allowing the spring 41 to retract the push spring quick-release 34.

Figure 9:
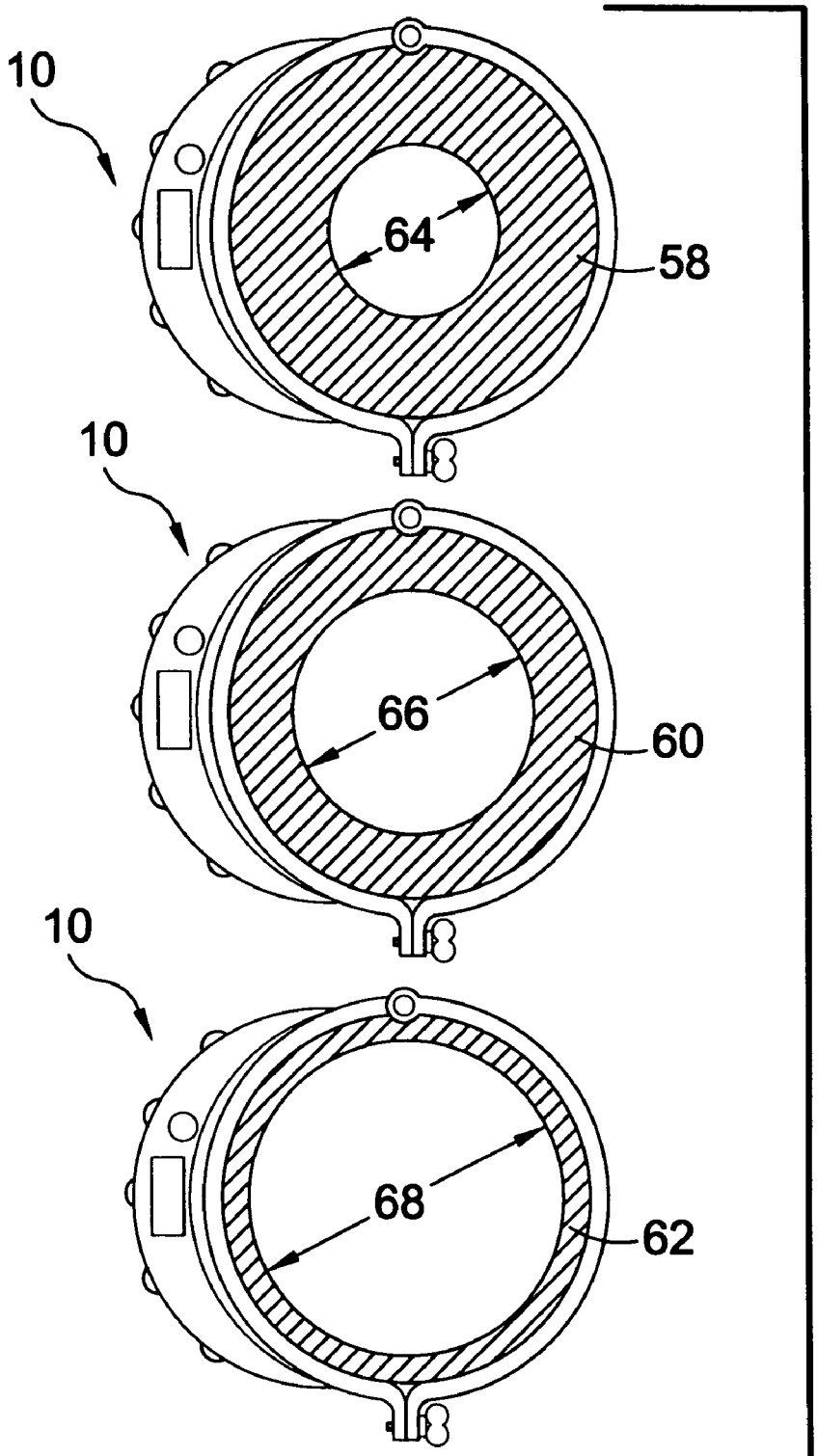
FIG. 9 is a top view of the present invention in a closed position with reduction gasket.

FIG. 9 is a top view of the present invention in a closed position with reduction gasket. Depicted in FIG. 9 is the present invention's reducer bushings 58,60,62 wherein the interior diameter 66 of bushing "B" 60 is greater than the interior diameter 64 of bushing "A" 58 and the interior diameter 68 of bushing "C" 62 thereby allowing the present invention 10 to be installed on vacuum wands of various diameters. The bushings 58,60,62 may be comprised of a resilient compressible material to provide a greater tolerance for odd diameter vacuum wands.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An illuminable attachment for a vacuum wand comprising:

a) a hinged clamp member having a top side and a bottom side and comprising a first semi-circular clamp element and a second semi-circular clamp element pivotally joined by a hinge;

b) means for securing the distal ends of said clamp elements to one another;

c) a light source disposed within a housing on at least one of said clamp element; and d) a non-slip coating disposed on the interior portion of said clamp member.

2. An illuminable attachment for a vacuum wand as recited in claim 1, wherein said light source comprises:

a) at least one light port;

b) a power source in electrical communication with each said light port; and c) a power switch to selectively enable and disable power distribution to said light port from said power source.

3. An illuminable attachment for a vacuum wand as recited in claim 2, wherein said power source is a DC battery disposed in a battery compartment proximal said light ports.

4. An illuminable attachment for a vacuum wand as recited in claim 2, having a plurality of light ports arranged in a semi-circular array.

5. An illuminable attachment for a vacuum wand as recited in claim 4, wherein said light port array is disposed on said bottom side of said clamp member.

6. An illuminable attachment for a vacuum wand as recited in claim 5, wherein each said light port includes a lamp.

7. An illuminable attachment for a vacuum wand as recited in claim 6, wherein lamp is an LED.

8. An illuminable attachment for a vacuum wand as recited in claim 1, wherein said securing means for said clamp elements comprises a pair of mating flanges disposed on the distal end of said first clamp member and the distal end of said second clamp member.

9. An illuminable attachment for a vacuum wand as recited in claim 8, wherein said flange of said second clamp element has a push spring quick-release comprising:

a) a thumb plate;

b) a shaft extending from said thumb plate; and c) at least one locking post extending perpendicularly from the distal end of said shaft.

10. An illuminable attachment for a vacuum wand as recited in claim 9, wherein said flange of said first clamp element has a keyway with a circular central portion sized to permit entry of said shaft therethrough and a cut-out peripherally disposed to accommodate passage of said locking post.

11. An illuminable attachment for a vacuum wand as recited in claim 10, wherein said clamp member is installed on a vacuum wand by enclosing said clamp elements therearound with said light array forwardly disposed relative to the vacuum head on said distal end of said wand and aligning and inserting said shaft and locking post through said keyway and cut-out and turning said thumb plate to misalign said locking post with said cut-out.

12. An illuminable attachment for a vacuum wand as recited in claim 11, wherein a spring is disposed on said shaft between said thumb plate and said flange of said second clamp element to provide a bias urging said thumb plate away from said flange.

13. An illuminable attachment for a vacuum wand as recited in claim 1, further comprising a reduction bushing having an external circumference substantially similar to the interior circumference of said clamp member and an interior circumference substantially equivalent to a standard size vacuum wand.

14. An illuminable attachment for a vacuum wand as recited in claim 13, further including a plurality of said reduction bushings with differing interior circumferences to accommodate different standard sized vacuum wands.

15. An illuminable attachment for a vacuum wand as recited in claim 13, wherein said reduction member is fabricated of a resilient compressible material allow for a greater tolerance when used with odd-sized vacuum wands.

16. An illuminable attachment for a vacuum wand comprising:

a) a hinged clamp member having a top side and a bottom side and comprising a first semi-circular clamp element and a second semi-circular clamp element pivotally joined by a hinge;

b) means for securing the distal ends of said clamp elements to one another;

c) a light source disposed within a housing on at least one of said clamp element;

d) said securing means for said clamp elements comprises a pair of mating flanges disposed on the distal end of said first clamp member and the distal end of said second clamp member; and e) said flange of said second clamp element has a push spring quick-release comprising:

i) a thumb plate;

ii) a shaft extending from said thumb plate; and iii) at least one locking post extending perpendicularly from the distal end of said shaft.

17. An illuminable attachment for a vacuum wand as recited in claim 16, wherein said light source comprises:

a) at least one light port;

b) a power source in electrical communication with each said light port; and c) a power switch to selectively enable and disable power distribution to said light port from said power source.

18. An illuminable attachment for a vacuum wand as recited in claim 17, wherein said power source is a DC battery disposed in a battery compartment proximal said light ports.

19. An illuminable attachment for a vacuum wand as recited in claim 17, having a plurality of light ports arranged in a semi-circular array.

20. An illuminable attachment for a vacuum wand as recited in claim 19, wherein said light port array is disposed on said bottom side of said clamp member.

21. An illuminable attachment for a vacuum wand as recited in claim 20, wherein each said light port includes a lamp.

22. An illuminable attachment for a vacuum wand as recited in claim 21, wherein lamp is an LED.

23. An illuminable attachment for a vacuum wand as recited in claim 16, wherein said securing means for said clamp elements comprises a pair of mating flanges disposed on the distal end of said first clamp member and the distal end of said second clamp member.

24. An illuminable attachment for a vacuum wand as recited in claim 23, wherein said flange of said second clamp element has a push spring quick-release comprising:

a) a thumb plate;

b) a shaft extending from said thumb plate; and c) at least one locking post extending perpendicularly from the distal end of said shaft.

25. An illuminable attachment for a vacuum wand as recited in claim 24, wherein said flange of said first clamp element has a keyway with a circular central portion sized to permit entry of said shaft therethrough and a cut-out peripherally disposed to accommodate passage of said locking post.

26. An illuminable attachment for a vacuum wand as recited in claim 25, wherein said clamp member is installed on a vacuum wand by enclosing said clamp elements therearound with said light array forwardly disposed relative to the vacuum head on said distal end of said wand and aligning and inserting said shaft and locking post through said keyway and cut-out and turning said thumb plate to misalign said locking post with said cut-out.

27. An illuminable attachment for a vacuum wand as recited in claim 26, wherein a spring is disposed on said shaft between said thumb plate and said flange of said second clamp element to provide a bias urging said thumb plate away from said flange.

28. An illuminable attachment for a vacuum wand comprising:

a) a hinged clamp member having a top side and a bottom side and comprising a first semi-circular clamp element and a second semi-circular clamp element pivotally joined by a hinge;

b) means for securing the distal ends of said clamp elements to one another;

c) a light source disposed within a housing on at least one of said clamp element; and d) a reduction bushing having an external circumference substantially similar to the interior circumference of said clamp member and an interior circumference substantially equivalent to a standard size vacuum wand.

29. An illuminable attachment for a vacuum wand as recited in claim 28, wherein said reduction member is fabricated of a resilient compressible material allow for a greater tolerance when used with odd-sized vacuum wands.

30. An illuminable attachment for a vacuum wand as recited in claim 28, further including a plurality of said reduction bushings with differing interior circumferences to accommodate different standard sized vacuum wands.

31. An illuminable attachment for a vacuum wand comprising:

a) a hinged clamp member having a top side and a bottom side and comprising a first semi-circular clamp element and a second semi-circular clamp element pivotally joined by a hinge;

b) means for securing the distal ends of said clamp elements to one another;

c) a light source disposed within a housing on at least one of said clamp element;

d) said light source comprises:

i) at least one light port;

ii) a power source in electrical communication with each said light port; and iii) a power switch to selectively enable and disable power distribution to said light port from said power source; and e) said power source is a DC battery disposed in a battery compartment proximal said light ports.

* * * * *